US006795101B2

(12) United States Patent
Van Der Meer et al.

(10) Patent No.: US 6,795,101 B2
(45) Date of Patent: Sep. 21, 2004

(54) DIRECT IMAGING PROCESS WITH FEED BACK CONTROL BY MEASURING THE AMOUNT OF TONER DEPOSITED

(75) Inventors: Rene Johannes Van Der Meer, Venlo (NL); Aart Nijkamp, Venlo (NL)

(73) Assignee: Oce-Technologies B.V., Venlo (NL)

( * ) Notice: Subject to any disclaimer, the term of this patent is extended or adjusted under 35 U.S.C. 154(b) by 111 days.

(21) Appl. No.: 10/120,409

(22) Filed: Apr. 12, 2002

(65) Prior Publication Data

US 2002/0158956 A1 Oct. 31, 2002

(30) Foreign Application Priority Data

Apr. 27, 2001 (EP) ..... 01201550

(51) Int. Cl.[7] ..... B41J 2/39; B41J 2/385; G03G 15/09; G03G 15/00

(52) U.S. Cl. ..... 347/142; 347/141; 399/49; 399/271

(58) Field of Search ..... 347/151, 141, 347/142, 158; 399/152, 60, 49, 159, 271

(56) References Cited

U.S. PATENT DOCUMENTS 3,909,258 A 9/1975 Kotz
5,287,127 A 2/1994 Salmon
5,666,194 A 9/1997 Denton
6,587,653 B2 * 7/2003 Luxem ..... 399/49

FOREIGN PATENT DOCUMENTS

EP 0 191 521 8/1986
EP 0 304 983 3/1989
EP 0 595 388 5/1994
EP 0 991 259 A1 4/2000
JP 01216378 A * 8/1989 ..... G03G/15/09

OTHER PUBLICATIONS

Patent Abstracts of Japan, vol. 004, No. 122—JP 55 077766, Jun. 11, 1980.

* cited by examiner

*Primary Examiner*—Susan Lee
(74) *Attorney, Agent, or Firm*—Birch, Stewart, Kolasch & Birch, LLP

(57) ABSTRACT

An image forming device includes an image forming element moving past an image forming station in which a toner is deposited on the surface of the image forming element, the image forming element having at least one electrode extending over a predetermined surface area of the image forming element. The image device also includes an impedance/capacitance measuring circuit measuring the amount of toner deposited on the predetermined surface area on the basis of a resulting change in the impedance/capacitance of the electrode.

15 Claims, 2 Drawing Sheets

DIRECT IMAGING PROCESS WITH FEED BACK CONTROL BY MEASURING THE AMOUNT OF TONER DEPOSITED

RELATED APPLICATION

The present application claims the priority benefit of the European Patent Application No. 01201550.9 filed Apr. 27, 2001, under 35 U.S.C. §119, which is herein fully incorporated by reference.

BACKGROUND OF THE INVENTION

1. Field of the Invention

The invention relates generally to image forming devices that are used in image reproduction systems, e.g. copiers or printers, in which a toner image is formed on a surface of an image forming element. Specifically, the invention relates to a so-called direct imaging process in which toner particles from a supply of toner in an image forming zone, are directly deposited on an insulating surface as a result of electrical energization of a printing electrode.

2. Discussion of the Related Art

Such direct imaging process are well known and are described, e.g., in U.S. Pat. No. 3,909,258, EP 191521, EP 295532 and EP 304983.

The image forming element is typically formed by a cylindrical drum or an endless belt which moves past an image forming station where the toner powder is applied to the insulating surface of the drum or belt under the control of electronic drivers and in accordance with the image information to be printed. The drivers control electrodes which generate an electric field for attracting the toner particles to the surface of the image forming element. A detailed description of the mechanism of toner deposition in a direct imaging process is provided in the above mentioned EP 191521.

The toner image that has been formed on the surface of the moving image forming element is then carried on to a transfer station where the toner image is transferred onto an intermediate image carrier or directly onto a recording sheet.

A malfunction of one or more of the drivers controlling the transfer of toner onto the surface of the image forming element will lead to a defect in the printed image. EP-A-0 991 259 discloses an image forming device having self-diagnosis means for detecting such malfunctions of the drivers by measuring an output characteristic of each of the drivers. The result of this self-diagnosis may be used for generating a signal advising the user that maintenance or repair is necessary. This signal may also identify the driver or drivers that are not functioning properly, so that the service personnel may readily take the necessary steps for exchanging or repairing the defective component. In addition, the result of the self-diagnosis may be used to activate correction means for automatically eliminating the malfunction or at least eliminating the visible effect thereof on the prints produced by the image forming device. For example, the malfunction may be eliminated by automatically activating a spare driver which will then take-over for the defective driver. As an alternative, the visible effect of a driver malfunction may be eliminated by automatically activating an image processing routine for modifying the image information to be printed such that the visible effect of the malfunction will be concealed as far as possible. However, the self-diagnosis means proposed in EP-A-0991259 can only detect a malfunction by reference to the output signals of the drivers, and they cannot verify the amount of toner that is actually deposited on the image forming element in response to the driver output signal.

SUMMARY OF THE INVENTION

It is an object of the invention to provide a method for directly detecting the amount of toner deposited on the surface of an image forming element, thereby to provide more powerful tools for self-diagnosis and/or self-correction in an image forming device and process.

It is another object of the invention to provide a method of detecting the amount of toner deposited on an image forming element, which overcomes the problems and disadvantages associated with the related art.

According to the invention, these objects are achieved by a method of detecting an amount of toner deposited on a surface area of an image forming element, the method including the step of measuring a change in the impedance/capacitance of an electrode extending over the surface area of the image forming element.

The invention is based on the effect that the amount of toner present on a given surface area of the image forming element will cause a measurable change in the impedance/capacitance of an electrode that extends over this surface area. Thus, the presence of toner on this surface area may be detected by reference to the measured impedance/capacitance, and the amount of toner may even be determined quantatively on the basis of a unique relation between the impedance/capacitance of the electrode and the deposited amount of toner. This unique relation may be determined experimentally in advance.

According to the invention, the surface area on which the amount of toner is detected will be defined by the configuration of the electrode and may incorporate the entire surface of the image forming element or only, e.g., a small portion thereof having, for example, the size of one or more pixels or a complete line or row of pixels. If, depending on the type of image forming process, the surface layer of the image forming element happens to be electrically conductive, then the electrode may be formed by the surface layer of the image forming element itself. On the other hand, if the image forming element has an electrically insulating surface layer, then the electrode may be embedded in the image forming element underneath this surface layer. Optionally, the electrode may also be arranged outside of the image forming element so as to face the surface thereof. In order to obtain a good signal-to-noise ratio, it is only required that the electrode is sufficiently close to the surface area of the image forming element, so that the dielectric properties of the toner deposited on this surface will influence the capacitance of the electrode. If, in case of an electrostatic image forming process for example, the image forming element has electrodes for generating an electric field that will attract the toner particles, then this electrode may conveniently be used for capacitive toner detection.

Measuring devices for measuring the impedance/capacitance of an electrode with high accuracy are, as such, well known and are used for example for capacitively measuring the thickness of plastic films and the like.

In one embodiment of the invention, the method of measuring the capacitance of the electrode comprises the steps of connecting the electrode to a voltage source and charging the electrode to a first predetermined potential, disconnecting the electrode from the voltage source and connecting it to a second predetermined potential, e.g. to ground, through an electronic integrator, and integrating the current flowing through the integrator while the electrode is discharged to the second predetermined potential. The result of the integration represents the change in the electric charge of the electrode, and by dividing this change of charge through the difference between the first and second predetermined potentials, one obtains directly the capacitance of the electrode. The integrator may for example be formed by an operational amplifier. Since, in this case, the discharge resistance for the electrode can be made very low, the capacitance can be measured with high accuracy even when the electrical insulation of the electrode from its environment is poor.

According to the present invention, another possible method of measuring the change in the capacitance of the electrode due to the toner being deposited on the surface of the image forming element may include keeping the potential of the electrode constant and measuring the amount of charge flowing to or from the electrode while the toner is being deposited on the image forming element. The measured charge divided by the constant potential of the electrode will then give the change in capacitance that has been caused by the toner.

In general, it is possible with existing technology, e.g., with Charge Coupled Devices (CCDs), to measure small electric charges even as small as a single electron charge with extremely high accuracy, e.g. in the order of a fC ($10^{-15}$C) or less, making it possible to detect extremely small amounts of toner and even to detect a single toner particle.

If the electrode and hence the surface area defined thereby has only very small dimensions at least in one direction, e.g. if it consists of a single pixel or a single row of pixels, then the impedance/capacitance may be influenced not only by the toner deposited on this surface area itself but also by the toner deposited on adjacent surface areas. These "edge effects" may however be taken into account when determining the relation between the impedance/capacitance and the amount of toner on the surface area.

The invention further relates to image forming methods and devices utilizing the above method of detecting the amount of toner.

When the toner detection method of the present invention is used for self-diagnosis or preventive maintenance purposes, it is possible to monitor not only the functions of the drivers controlling the direct imaging process but also the functions of other components and other parameters that have an impact on this process, e.g. the function of a toner supply system, changes in the surface properties of the image forming element, changes in the properties and composition (e.g. particles size distribution) of the toner and the like. When this method is combined with the means for monitoring the output signals of the drivers as described in EP-A-0 991 259, it is possible to provide a detailed diagnosis result which permits to facilitate and speed-up maintenance and repair operations to a considerable extent.

Moreover, the toner detection method of the present invention may be used for enhancing and adding self-correction facilities in an image forming device. If it is detected for example in an electrostatic direct imaging device that the amount of toner deposited on the image forming element is, for any reason, smaller than desired, then this effect may be compensated by modifying the output signal of the driver, e.g. by increasing the voltage applied to the imaging electrode and/or the counter electrode, so that the deposited amount of toner is increased. In this way, it is possible to control the optical density of the printed image with unprecedented accuracy. It will be understood that this is particularly useful in colour printing or copying operations in which the hue of the colour image depends critically on the optical densities of the various colour components.

The toner detection method of the present invention may also be used for improving other correction measures that are implemented already in existing image forming devices. For example, if a driver associated with a given pixel position on the image forming element outputs a pulse signal with a pulse duty ratio of 50% while the image forming element moves past the image forming station, this would result in a one pixel-wide broken line being drawn on the image forming element, and the average optical density of this line should, theoretically, be 50%. In practice, however, the average optical density of the line will not be 50%, but will be slightly smaller or larger, depending on the properties and conditions of the image forming process. A known method for compensating this type of error includes lengthening or shortening the "on" periods of the pulsed signal output from the driver, e.g. by advancing or retarding the trailing edge of each pulse by a certain delay time. Now, the present invention offers the possibility to adapt this delay time dynamically in accordance with the actual optical density that is determined by reference to the measured amount of toner.

Such self-correcting or self-adjusting features of the present invention may be implemented in an image reproduction system employing the image forming device by causing the system to perform a self-test either upon a user instruction or in regular intervals. Alternatively, a self-test operation may be performed automatically each time an image has been printed. Since the measurement of the amount of toner can be performed within extremely short time, it is even possible to perform a self-adjusting operation continuously and essentially in real-time while an image is being printed. Eventually, this leads to an image forming method in which the drivers are feedback controlled on the basis of the measured amount of toner, so that the optical density of the image being formed is controlled to a target value with high reliability and accuracy.

This concept may be developed further to provide a halftone image forming process. Most commonly used image forming devices are only capable of printing either black or white pixels. Halftones are generated by dividing the pixel into a regular or irregular pattern of sub-pixels, on the cost of image resolution, with the grey value of the pixel as a whole being determined by the ratio between black and white sub-pixels. Since it is possible with the toner detection method according to the invention to measure the amount of toner applied to an individual pixel quantitatively, the amount of toner for a given pixel can be controlled so as to correspond to a desired grey value. Thus, since it is no longer necessary to divide the pixel into sub-pixels, halftone images can be printed with extremely high spatial resolution.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Preferred embodiments of the invention will now be described in conjunction with the drawings, in which.

DESCRIPTION OF THE PREFERRED EMBODIMENTS

Figure 1:
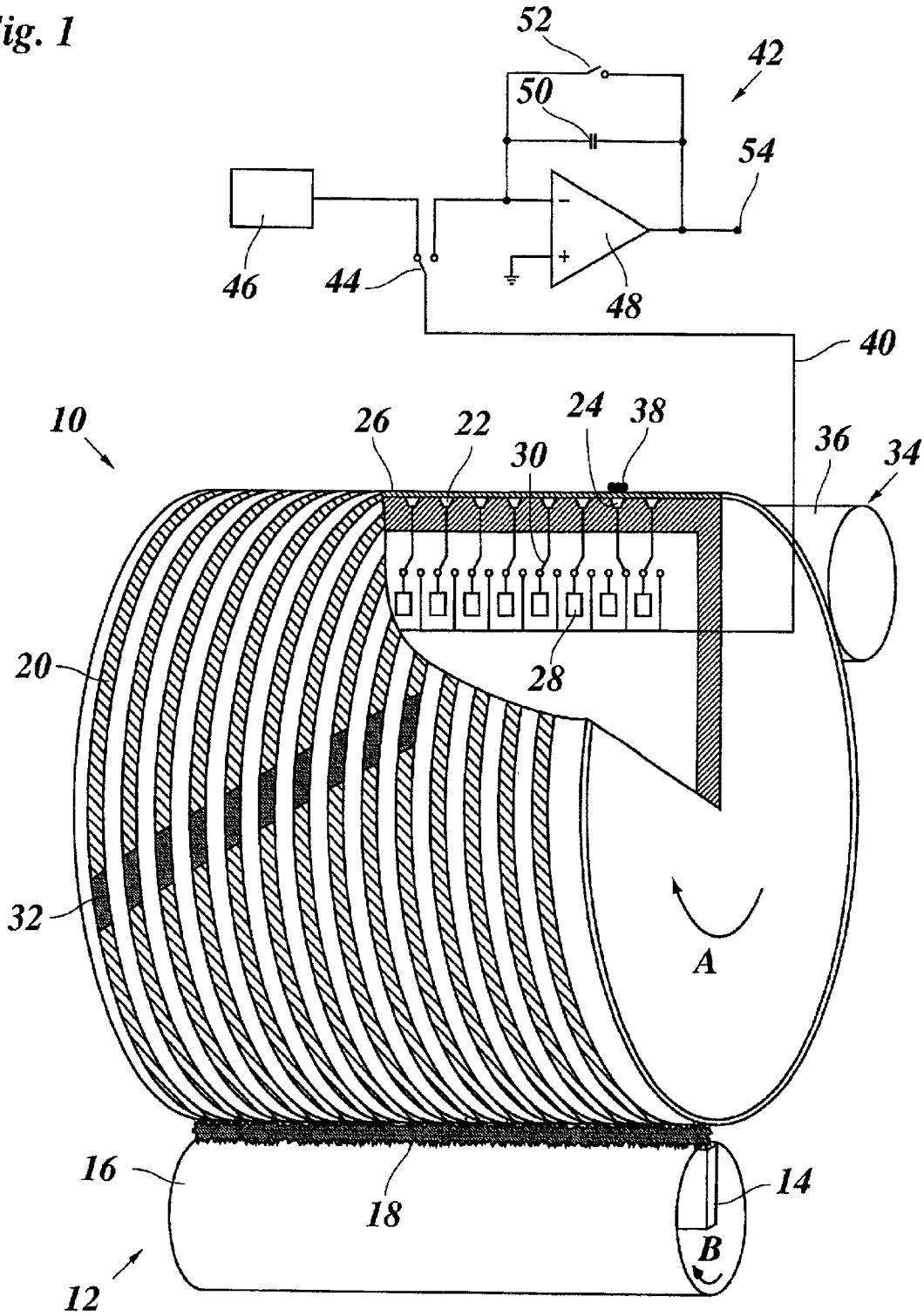
FIG. 1 is a diagram of an image forming device illustrating the principles of the invention.

FIG. 1 is a diagram of an image forming device illustrating the principles of the invention. As is shown in FIG. 1, the image forming device comprises an image forming element shaped as a drum 10 which is rotated in the direction of an arrow A, so that its circumferential surface moves past an image forming station 12. The image forming station 12 comprises a stationary magnetic knife 14 which extends in parallel with the axis of the drum 10 in close proximity to the drum surface. The magnetic knife 14 is surrounded by a non-magnetisable metal sleeve 16 which rotates in the same direction as the drum 10 and feeds toner powder supplied by a toner supply mechanism (not shown) to the edge of the magnetic knife 14. Since the particles of the toner powder are magnetically attractable, they form a toner brush 18 in the small gap between the sleeve 16 and the drum 10.

The circumferential surface of the drum 10 has a regular pattern of circular tracks 20 extending in the circumferential direction. The widths and the pitch of the tracks 20 are greatly exaggerated in the drawing. In practice, each of the tracks 20 corresponds to a single column of pixels of the image to be formed on the surface of the drum 10. Thus, when the image resolution of the image forming device is 400 dpi, there will be as many as 400 tracks per inch (per 2.54 cm) in the axial direction of the drum 10.

As has been shown in the sectioned part of the drum 10, the tracks 20 are formed by circular electrodes 22, 24 that are embedded in the wall of the drum 10 so as to be electrically insulated from one another and are covered by an electrically insulating surface layer 26 of the drum. Each of the electrodes 22, 24 is associated with a driver 28 which controls a voltage to be applied to the corresponding electrode and is connectable to the corresponding electrode through a switch 30. A more detailed description of the structure and manufacture of the drum is given in EP 595388, the description of which is incorporated herein by reference.

In order to form a toner image on the surface of the drum 10, the drivers 28 are activated in accordance with the image information to be printed. When an individual pixel is to be formed, a short voltage pulse of, e.g., 40V is applied to the electrode 20 associated with the position of the pixel at the very timing when the point where the pixel is to be formed passes the magnetic brush 18. Since the sleeve 16 is grounded, an electric field develops across the gap between the sleeve 16 and the drum 10 at the position where the pixel is to be formed, and this electric field causes toner particles from the toner brush 18 to be transferred onto the surface of the drum 10, so that a toner pixel is formed on the drum. In the example shown, some of the electrodes 22 have been energized in staggered timings, so that a slanting line 32 of toner pixels has been formed on the surface of the drum. When no pixel is to be formed on the track 20 passing the toner brush 18, the corresponding driver 28 is kept de-energized, and the associated electrode 22 is kept approximately at the ground potential. More precisely, a minor offset voltage may be necessary in order to prevent toner particles from being transferred onto the drum and forming a non-desired shaded background. In a transfer station 34, the toner image formed on the surface of the drum 40 is transferred, for example, onto a recording sheet (not shown) which is fed into a nip between the drum 10 and a pressure roller 36.

When toner particles 38 adhere to the surface of the insulating layer 26 covering, e.g., the electrode 24, the electrical properties of the toner particles 38 will change the impedance/capacitance of this electrode 24. As a result, the impedance/capacitance of the electrode 24 will depend on the amount of toner powder that is deposited on the surface area of the drum 10 defined by this electrode 24, i.e. on the corresponding track 20. In order to detect the amount of toner deposited on each of the tracks 20, each electrode 22, 24 is electrically connectable through the switch 30 and a line 40 to a capacitance measuring circuit 42. In the shown embodiment, the capacitance measuring circuit 42 comprises a switch 44, a voltage source 46, an integrator formed by an operational amplifier 48 and a capacitor 50 in the feedback line of the operational amplifier 48, and a reset switch 52 for short-circuiting the capacitor 50.

In order to measure the capacitance of the electrode 24, this electrode 24 is at first electrically connected to the voltage source 46 through the line 40 and the switch 44, so that the electrode 24 is charged with a fixed output voltage of the voltage source 46. Then, the switch 44 is switched-over so as to electrically connect the line 40 to the inverting input of the operational amplifier 48, the non-inverting input of which is grounded, so that the electrode 24 is discharged through the operational amplifier 48. The discharge current flowing through the operational amplifier 48 is integrated, and when the electrode 24 is discharged completely, the time integral of the current, i.e. the charge that has flown off from the electrode 24 can be detected at the output 54 of the capacitance measuring circuit 42. The capacitance of the electrode 24 is equal to the charge indicated at the output 54 divided by the voltage of the voltage source 46. In order to eliminate statistical errors, the measurement can be repeated several times by switching the switch 44 back and forth, with the integrator being reset after each measurement by closing the reset switch 52.

To calibrate the system, a solid black image or any other suitable test image may be formed on the drum 10, and then the impedance/capacitance of each of the electrodes 22, 24 is measured as described above, and the measured values are stored in a table. When the image forming device has been in use for a certain time, the measurements may be repeated, and by comparing the new test results with the stored values, it is possible to detect any type of malfunction in the image forming system which leads to a wrong amount of toner being deposited on the drum. Since the measurements are made track by track, it is also possible to identify the track suffering from a malfunction according to the present invention.

Optionally, the impedances/capacitances of the electrodes 22, 24 may be measured when an arbitrary image has been formed on the drum 10. Since the expected value for the average optical density on each track 20 is known from the image information, and the capacitance of the electrode is roughly proportional to the average optical density, the results obtained for an arbitrary image may be compared to the results of the calibration measurement by taking the different optical densities into account. In order to correct non-linearities in the relation between the amount of toner deposited on a track 20 and the capacitance of the associated electrode 22 or 24, it is also possible to conduct several calibration measurements with different optical densities and to store the results in the form of a look-up table or in the form of coefficients of a polynomial function approximating the measured relation between capacitances and optical densities. Similarly, calibration measurements can be made for different pixel patterns within the track, so as to determine how the capacitance of the electrode depends on the pattern of the toner distribution on the track.

In the shown embodiment, the capacitance of a given electrode 24 may also be influenced by toner particles deposited not on the electrode 24 itself but on the electrodes 22 directly adjacent thereto. This effect can also be determined and taken into account by suitable calibration measurements.

The capacitance measurements may be performed while the toner image on the surface of the drum is in the process of being formed. When such measurements are repeated after each pixel or after each group of several pixels, the increase in capacitance from measurement to measurement will reflect the amount of toner that has been deposited for this pixel or group of pixels and may be compared to the expected value that is derived from the image information. This has the advantage that the increase in capacitance from measurement to measurement will depend only on the contents of the few pixels that have been printed in the interval between the two measurements and possibly on the contents of the pixels on the neighbouring tracks. Thus, only a limited number of different pixel patterns has to be taken into consideration for determining the expected value with which the measured capacitance is to be compared.

Thus, according to a particular mode of the invention, a direct imaging process is provided in which a control circuit generates a signal representative of the optical density of a pixel or series of pixels to be printed. In accordance with this control signal, the respective electrode or electrodes 22 are energized until in a feed back control it is established that the impedances of the respective electrodes 22 have reached the value that corresponds with the optical density to be printed. Accordingly, a direct imaging process is provided in which images are printed based on control signals representating the optical densities to be achieved for the several image areas. Calibration of the printing system can be done, from time to time, by printing optical density test charts, on a receiving paper, scanning the print and comparing the optical density of the scanned areas with the stored value and re-defining impedance values to compensate for the deviations measured.

Another advantage of this method is that the toner receiving properties of the drum 10 can be detected with high angular resolution, so that it is possible for example to detect stains on the drum which influence the toner adhesion.

If the increase in capacitance measured for one or a few pixels deviates significantly from the target value that has been calculated from the pixel pattern, it is also possible to compensate for this deviation immediately, e.g., by adjusting the output voltage of the driver 28 that controls the pertinent electrode.

Since, in the shown embodiment, the electrode the capacitance of which is to measured has to be disconnected from its driver 28, the capacitance measurement can be made only in those time intervals in which the electrode is inactive. If the electrodes are controlled by their drivers 28 in a pulse-like manner, with separate pulses for each individual pixel, then the capacitance measurement can be made in the interval between subsequent pulses. Otherwise, the capacitance measurement can be made during a time period in which the electrode is printing "white" pixels in accordance with the image information.

If the voltage supplied by the voltage source 46 is in the same order of magnitude as the voltage applied to the electrode by the associated driver 28, then the voltage pulse applied by the voltage source 46 may also lead to the deposit of a certain amount of toner on the corresponding track. However, since the pulse applied by the voltage source 46 can be made extremely short, this amount of toner can be made neglectable. On the other hand, this voltage can at the same time also be used for printing the toner images.

It will be understood that the measurements described above according to the present invention may also be used to confirm that no toner is deposited on the track when the associated electrode is inactive. Such measurements may be used for example in order to optimize the above-mentioned offset voltage which assures a background-free image.

In a practical embodiment, the drivers 28 and the circuitry of the measuring circuit 42, which has only been shown schematically in FIG. 1, may be implemented in integrated circuits on a printed circuit board that is incorporated inside of the drum 10 and is connected to the outside through rotary couplings.

In a modified embodiment, the switch 44 and the voltage source 46 may be dispensed with, and, instead, the drivers 28 may be used for applying a predetermined voltage to the electrodes 22, 24 for the purpose of capacitance measurement.

Further, while FIG. 1 shows only a single capacitance measuring circuit 42 which "scans" the electrodes 22, 24 one after the other (by means of the switches 30), it is possible to provide a plurality of capacitance measurement circuits 42 each of which measures the capacitance of only one or a few of the electrodes 22, 24 according to the present invention.

Figure 2:
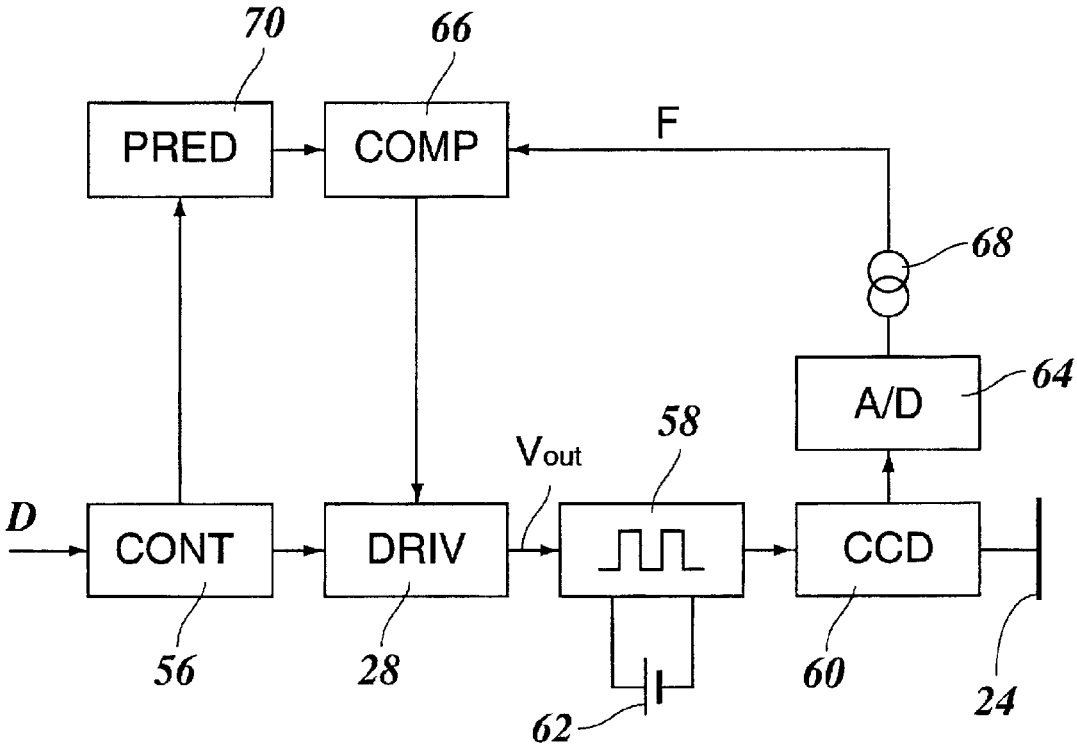
FIG. 2 is a block diagram of a control circuit for controlling an electrode of an electrostatic image forming device according to a preferred embodiment of the present invention.

FIG. 2 shows a functional block diagram of a modified embodiment of a circuit for controlling the voltage applied to a single electrode 24 of the image forming element and for measuring the capacitance of this electrode according to the present invention. As shown, the control circuit comprises a controller 56 which receives image data D of an image to be printed and controls all the drivers 28 associated with the electrodes 22, 24 shown in FIG. 1. The driver 28 generates an output voltage $V_{out}$ to be applied to the electrode 24 in order to cause toner particles to be deposited on the associated track 20. The output voltage $V_{out}$ is applied to the electrode 24 through an oscillator 58 and a charge detection device 60 such as a charge coupled device. The oscillator 58 superposes the output voltage $V_{out}$ with a pulsed detection voltage generated by a voltage source 62. On the leading edge of each pulse of the detection voltage, a certain amount of charge, which depends on the capacitance of the electrode 24, flows to the electrode 24. On the trailing edge of the pulse of the detection voltage, the same amount of charge flows back from the electrode 24 to the charge detection device 60 and is detected thereby. An analog/digital converter 64 receives and converts the detected analog charge signal from the charge detection device 60 into a digital feedback signal F which indicates the capacitance of the electrode 24 and which is fed to a comparator 66 through a potential-free coupler 68. The coupler 68 permits the oscillator 58, the charge detection device 60 and the converter 64 to be held at the potential $V_{out}$ so that the potential of these components will differ from the potential of the electrode 24 only by the detection voltage generated in the oscillator 58.

On the other hand, the controller 56 transmits the image signal for a pixel or a group of pixels to be printed with the electrode 24 and also the image signals for the neighbouring pixels to a predictor 70. The predictor 70 predicts, on the basis of the image pattern for these pixels, the increase in the capacitance of the electrode 24 that would be expected when the amount of toner above the electrode 24 is increased in accordance with the image signal. To this end, the predictor 70 may refer to the results of calibration measurements as discussed above. The comparator 66 compares the predicted increase in capacitance with the actual increase of the feedback signal F and adjusts the output of the driver 28 in accordance with the comparison result, so that the amount of toner accumulating on the track of the electrode 24 is feedback-controlled.

As an example, it may be assumed that the comparator 66 modifies the amplitude of the output voltage $V_{out}$ for the subsequent pixel or group of pixels to be printed. Thus, when a comparison between the feedback signal F and the signal received from the predictor 70 shows that the deposited amount of toner was too small, the comparator 66 increases the amplitude of the output voltage $V_{out}$ for the next pixels, so that a sufficient amount of toner will be applied for the subsequent pixel or groups of pixels. In this way, any deviation between the required amount of toner and the amount of toner actually deposited on the surface of the image forming element will be corrected cyclically with a cycle time corresponding to one or several pixels.

The method according to the present invention is applicable not only to black/white printing but also to halftone printing or any other printing type. In the halftone printing case, the output voltage $V_{out}$ will be variable in accordance with the required grey value. The comparator 66 then adjusts the gain with which the signal received from the controller 56 is transformed into the output voltage $V_{out}$.

As another example, it may be assumed that the comparator 66 controls the timings at which the driver 28 switches the output voltage $V_{out}$ on and off. For example, at the start of a sequence of one or more black pixels to be printed with the electrode 24, the controller 56 will trigger the driver 28 to switch the output voltage on. The feedback signal F will then gradually increase in accordance with the toner that is successively deposited on the track of the electrode 24. When the amount of toner represented by the feedback signal F reaches the value indicated by the predictor 70, i.e. the value required for the number of black pixels to be printed, the comparator 66 sends an off-signal to the driver 28 and the output voltage $V_{out}$ is switched off.

In a modified embodiment, the detection cycles of the charge detection device 60 may be controlled by a separate clock signal, and the period of the detection cycles may be significantly shorter than the pulse length of the pulses generated by the oscillator 58. In each detection cycle, the charge detection device 60 will then detect only a charge that has flown onto the electrode 24 due to the addition of toner particles on the track. The feedback signal F will then indicate only the increase in the capacitance of the electrode 24 rather than the total capacitance of this electrode. In the comparator 66, the measured increase in capacitance can be compared directly to the signal of the predictor 70. In this embodiment, the oscillator 58 would only be optional, and its pulses could be used for checking the total capacitance of the electrode 24 from time to time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of detecting an amount of toner deposited on a surface area of an image forming element, the method comprising:

measuring a change in an impedance or capacitance of an electrode extending over said surface area, wherein said electrode is an electrode that is also used for electrically attracting toner powder to the surface area of the image forming element in an image forming process.

2. The method according to claim 1, wherein a potential of the electrode is kept constant while the toner is applied to said surface area and wherein the change in capacitance is determined by measuring an amount of charge flowing to or from the electrode in response to the change in the impedance or capacitance that is caused by the deposit of additional toner on said surface area.

3. A method of forming a toner image on a surface of an image forming element, wherein at least one driver is controlled so as to generate an electric and/or magnetic field for attracting toner particles onto the surface of the image forming element, wherein the method according to claim 1 is used for monitoring and/or controlling an image forming process.

4. The method according to claim 3, wherein the driver is feedback-controlled on the basis of a detected amount of toner.

5. The method according to claim 3, wherein an amplitude of an output signal of the driver is feedback-controlled on the basis of the detected amount of toner.

6. The method according to claim 3, wherein the driver delivers an output signal in the form of pulses, and the length of the pulses is controlled on the basis of the detected amount of toner.

7. A method of detecting an amount of toner deposited on a surface area of an image forming element, the method comprising:

measuring a change in an impedance or capacitance of an electrode extending over said surface area, and the impedance or capacitance of the electrode is measured by changing a potential of the electrode by a predetermined voltage and detecting an amount of charge flowing to or from the electrode in response to the change in the potential, wherein the measuring step includes the steps of:

connecting the electrode to a first predetermined potential of a voltage source until the electrode is charged to this potential;

disconnecting the electrode from the voltage source and then connecting the electrode, through an integrator, to a second predetermined potential, so that the electrode is discharged with a low discharge resistance through the integrator; and integrating a discharge current flowing through the integrator until the electrode is discharged to the second predetermined potential.

8. The method according to claim 7 wherein the potential of the electrode is kept constant while the toner is applied to said surface area and wherein the change in capacitance is determined by measuring the amount of charge flowing to or from the electrode in response to the change in the impedance or capacitance that is caused by the deposit of additional toner on said surface area.

9. A method of forming a toner image on a surface of an image forming element, wherein at least one driver is controlled so as to generate an electric and/or magnetic field for attracting toner particles onto the surface of the image forming element, wherein the method according to claim 7 is used for monitoring and/or controlling an image forming process.

10. The method according to claim 9, wherein the driver is feedback-controlled on the basis of a detected amount of toner.

11. The method according to claim 10, wherein an amplitude of an output signal of the driver is feedback-controlled on the basis of the detected amount of toner.

12. The method according to claim 10, wherein the driver delivers an output signal in the form of pulses, and the length of the pulses is controlled on the basis of the detected amount of toner.

13. An image forming device comprising:

an image forming element moving past an image forming station in which a toner is deposited on a surface of the image forming element, said image forming element having at least one electrode extending over a predetermined surface area of the image forming element; and at least one measuring circuit measuring an amount of toner deposited on said predetermined surface area on the basis of a resulting change in an impedance or capacitance of the electrode, wherein the image forming element is a drum having a plurality of electrodes extending circumferentially on or below an outer surface of the drum and corresponding each to a row of pixels of a toner image to be formed, wherein each of said electrodes of the drum is electrically connectable to one of said measuring circuits.

14. The image forming device according to claim 11 wherein at least one of said measuring circuits includes:

a voltage source supplying a voltage signal;

an integrator integrating and detecting the amount of toner deposited on said predetermined surface area; and a switch electrically connecting one of the electrodes to either the voltage source or the integrator.

15. The image forming device according to claim 13, wherein said at least one electrode is an electrode used for electrically attracting toner particles to the surface area of the image forming element in an image forming process.

* * * * *